US007740668B2

(12) United States Patent
Gaughan et al.

(10) Patent No.: US 7,740,668 B2
(45) Date of Patent: Jun. 22, 2010

(54) UNLEADED AMINATED AVIATION GASOLINE EXHIBITING CONTROL OF TOLUENE INSOLUBLE DEPOSITS

(75) Inventors: Roger Grant Gaughan, Sewell, NJ (US); Daniel Dawson Lowrey, Westville, NJ (US); Daniel Eugene Kadlecek, London (GB); Dennis Harold Hoskin, Westhampton, NJ (US)

(73) Assignee: ExxonMobil Research & Engineering Company, Annandale, NJ (US)

( * ) Notice: Subject to any disclaimer, the term of this patent is extended or adjusted under 35 U.S.C. 154(b) by 1164 days.

(21) Appl. No.: 11/288,761

(22) Filed: Nov. 29, 2005

(65) Prior Publication Data

US 2006/0123696 A1 Jun. 15, 2006

Related U.S. Application Data

(60) Provisional application No. 60/631,718, filed on Nov. 30, 2004.

(51) Int. Cl.
*C10L 1/19* (2006.01)
*C10L 1/223* (2006.01)

(52) U.S. Cl. ..... 44/426; 44/389; 44/412; 44/451

(58) Field of Classification Search ..... 44/347, 44/437, 451, 426
See application file for complete search history.

(56) References Cited

U.S. PATENT DOCUMENTS

| | | | | | |
|---|---|---|---|---|---|
| 5,089,028 | A | * | 2/1992 | Abramo et al. | 44/347 |
| 5,114,435 | A | * | 5/1992 | Abramo et al. | 44/348 |
| 5,470,358 | A | * | 11/1995 | Gaughan | 44/426 |
| 5,492,005 | A | | 2/1996 | Homan et al. | 73/61.62 |
| 5,851,241 | A | | 12/1998 | Studzinski et al. | 44/359 |
| 5,962,775 | A | | 10/1999 | Liiva et al. | 73/35.02 |
| 6,258,134 | B1 | | 7/2001 | Studzinski et al. | 44/359 |
| 2002/0055663 | A1 | | 5/2002 | Barnes et al. | 585/14 |
| 2003/0000131 | A1 | * | 1/2003 | Henry et al. | 44/437 |

* cited by examiner

*Primary Examiner*—Ellen M McAvoy
*Assistant Examiner*—Ming Cheung Po

(57) ABSTRACT

The present invention relates to an unleaded aminated aviation gasoline of high motor octane number (MON) and low toluene insoluble deposit formation containing an additive for controlling said deposits selected from the group consisting of high molecular weight hydrocarbyl amines, high molecular weight hydrocarbyl succinimide, high molecular weight hydrocarbyl substituted Mannish bases, and mixtures thereof, and optional carrier oil(s), to an additive concentrate for controlling toluene insoluble deposits, and to a method for producing the additive concentrate.

41 Claims, No Drawings

UNLEADED AMINATED AVIATION GASOLINE EXHIBITING CONTROL OF TOLUENE INSOLUBLE DEPOSITS

This application claims the benefit of U.S. Ser. No. 60/631,718 filed Nov. 30, 2004.

BACKGROUND OF THE INVENTION

1. Field of the Invention

The present invention relates to unleaded aminated aviation gasoline of high octane number of low deposit formation, to an additive for controlling deposits, to an additive concentrate for controlling deposits and to a method for producing the additive concentrate.

2. Description of the Related Art

The high octane requirements of aviation gas for use in piston driven aircraft which operate under severe requirements, e.g., aircraft containing turbo-charged piston engines, require that commercial aviation fuels contain a high performance octane booster. The organic octane boosters for automobile gasolines (Mogas) such as benzene, toluene, xylene, methyl tertiary butyl ether, ethanol, and the like, are not capable by themselves or in combination of boosting the motor octane number (MON) to the 98 to 100+ MON levels required for aviation gasolines (Avgas). Tetraethyl lead (TEL) is therefore a necessary component in high octane Avgas as an octane booster.

Compositionally, Avgas is different from Mogas. Avgas, because of its higher octane and stability requirements, is typically a blend of isopentane, alkylate, toluene and tetraethyl lead. A typical Avgas base fuel without octane booster such as tetraethyl lead has a MON of 88 or higher, typically 88 to 97. Mogas, which has lower octane requirements, is a blend of many components such as butane, virgin and rerun naphtha, light, intermediate and heavy cat naphthas, reformate, isomerate, hydrocrackate, alkylate and ethers, or alcohols. Octane requirements of Mogas are based on research octane numbers (RON). For a given fuel, the RON is on average 10 octane numbers higher than its corresponding MON. Thus, the average premium Mogas possesses a MON of 86 to 88, whereas current Avgas must have a MON of 99.5. MON, not RON, is the accepted measure of octane for Avgas and is measured using ASTM D2700-92.

Conventional octane booster for Mogas, such as benzene, toluene, xylene, methyl tertiary butyl ether and ethanol are capable of boosting the MON of unleaded Avgas to the 92 to 95 MON range if added to Avgas in high enough concentrations. As noted previously, this is insufficient to meet the needs of 98+ MON high octane Avgas.

With the phasing out of tetra-ethyl lead as an octane booster resort must be made to other means for boosting octane.

U.S. Pat. No. 5,470,358 teaches a high octane unleaded aviation gasoline comprising unleaded aviation gasoline base fuel having a motor octane number of 90-93 and an amount of at least one aromatic amine effective to boost the motor octane number of the base fuel to at least about 98, the aromatic amine having the formula

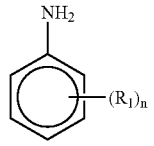

wherein $R_1$ is $C_1$-$C_{10}$ alkyl, n is an integer of from zero to 3 with the proviso that $R_1$ cannot occupy the 2- or 6-position on the aromatic rings.

Alternatively the fuel can comprise the same base fuel and an amount of at least one aromatic amine effective to boost the motor octane number of the base fuel to at least 98, said aromatic amine being a halogen substituted phenyl-amine or a mixed halogen and $C_1$-$C_{10}$ alkyl substituted phenylamine again with the proviso that the alkyl group cannot occupy the 2- or 6-position on the phenyl ring.

Preferred halogens are Cl or F. When $R_1$ is alkyl, it occupies the -3, -4, or -5 (meta- or para-) positions on the benzene ring. Alkyl groups in the 2- or 6-position result in aromatic amines which cannot boost octane to a MON value of 98. Examples of preferred aromatic amines for octane improvement include phenylamine, 4-tert-butylphenylamine, 3-methylphenylamine, 3-ethylphenylamine, 4-methylphenylamine, 3,5-dimethylphenylamine, 3,4-dimethylphenylamine, 4-isopropylphenylamine, 2-fluorophenylamine, 3-fluorophenyl amine, 4-fluorophenylamine, 2-chlorophenylamine, 3-chlorophenylamine and 4-chlorophenylamine. Especially preferred are 3,5-dimethylphenylamine, 3,4-dimethylphenylamine, 2-fluorophenylamine, 4-fluorophenylamine, 3-methylphenylamine, 3-ethylphenylamine, 4-ethylphenylamine, 4-isopropylphenylamine and 4-t-butylphenylamine.

U.S. Pat. No. 5,851,241 and its continuation U.S. Pat. No. 6,258,134 are directed to aviation fuel compositions which contain a combination of an alkyl tertiary butyl ether, an aromatic amine and optionally a manganese component such as methyl cyclopentadenyl manganese tricarbonyl (MMT). The base fuel to which the additive combination may be added may be a wide boiling range alkylate base fuel. According to the patents the combination of the alkyl tertiary butyl ether, the aromatic amine and, optionally, the manganese component result in a synergistic combination while boosts the MON of the fuel to a degree greater than the sum of the MON increases for each additive when used individually in the base fuel.

Unleaded aminated aviation gasoline, however, has been found to exhibit the formation of toluene insoluble deposits in a test designed to determine the deposit formation capability of fuel (U.S. Pat. No. 5,492,005). Toluene insoluble deposits are not easily washed away by fuel, represented in the test procedure of U.S. Pat. No. 5,492,005 by n-heptane and toluene. It would be desirable to find a way to control the toluene insoluble deposits associated with such fuel.

DETAILED DESCRIPTION OF THE INVENTION

It has been found that the toluene insoluble deposits of unleaded aminated aviation gasoline can be controlled by addition to the fuel of an effective amount of particular deposit control additives selected from the group consisting of high molecular weight hydrocarbyl amine, high molecular weigh hydrocarbyl succinimides, high molecular weight hydrocarbyl substituted Mannich bases and mixtures thereof, and, optionally further including a carrier oil.

The unleaded aminated high octane aviation gasoline which contains the deposit control additive comprises a blend of a base aviation gasoline having a base Motor Octane Number MON of less than 98 and an effective amount of at least one aromatic amine effective to boost the MON of the base fuel to at least 98, the aromatic amine having the formula [I]

[I]

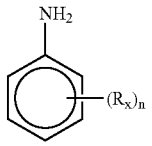

wherein $R_x$ is $C_1$-$C_{10}$ alkyl, halogen or a mixture thereof, n is an integer of from 0 to 3 provided that when n is 1 or 2 and $R_x$ is an alkyl group it occupies the meta and/or para position on the phenyl ring.

Preferred halogens are Cl or F. When $R_1$ is alkyl, it occupies the -3, -4, or -5 (meta or para) positions on the benzene ring. Alkyl groups in the 2- or 6-position result in aromatic amines which cannot boost octane to a MON value of 98. Examples of preferred aromatic amines for octane improvement include phenylamine, 4-tert-butylphenylamine, 3-methylphenylamine, 3-ethylphenylamine, 4-methylphenylamine, 3,5-dimethylphenylamine, 3,4-dimethylphenylamine, 4-isopropylphenylamine, 2-fluorophenylamine, 3-fluorophenylamine, 4-fluorophenylamine, 2-chlorophenylamine, 3-chlorophenylamine and 4-chlorophenylamine. Especially preferred are 3,5-dimethylphenylamine, 3,4-dimethylphenylamine, 2-fluorophenylamine, 4-fluorophenylamine, 3-methylphenylamine, 3-ethylphenylamine, 4-ethylphenylamine, 4-isopropylphenylamine, 4-t-butylphenylamine, and 4-isoamylphenyl amine.

The deposit control additive is added in an amount up to about 1000 wppm, preferably up to about 500 wppm, more preferably up to about 250 wppm, most preferably up to about 100 wppm, active ingredient of the deposit control additive. By active ingredient, when used in regard to the deposit control additive, is meant the amount of actual deposit control additive employed without regard for any diluents, carrier oil, unreacted starting material or coproduced secondary reaction products which may be present in the deposit control additive as produced or as received from the manufacturers.

High molecular weight hydrocarbyl amines are generally represented by the formula [II]

[II]

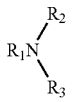

wherein $R_1$ is the high molecular weight hydrocarbyl group containing about 30 to about 200 carbons and having a weight average molecular weight (Mw) of about 400 to 2800, preferably about 500 to about 2000, more preferably about 500 to 1500, most preferably about 1000 to 1200, and are usually homo- or copolymer of low molecular weight $C_2$ to $C_6$ olefins, e.g., polyisobutylene, $R_2$ and $R_3$ are the same or different and are selected from hydrogen, $C_2$ to $C_{10}$ alkyl,

[III]

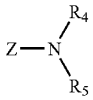

wherein Z is a $C_1$-$C_{10}$ alkylene, $R_4$ and $R_5$ are the same or different and are selected from hydrogen, $C_1$-$C_{10}$ alkyl, $C_1$-$C_{10}$—OH, preferably $R_2$ and $R_3$ are hydrogen, $C_2$-$C_4$ alkyl,

[IV]

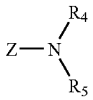

wherein Z is a $C_1$-$C_{10}$ alkylene, $R_4$ and $R_5$ are hydrogen, $C_1$-$C_4$ alkyl, $C_1$-$C_4$—OH, more preferably $R_1$ is 1000-1200 Mw polyisobutylene, $R_2$ and $R_3$ are the same or different and selected from hydrogen, $C_2H_4$—$NH_2$, $C_2H_4N(H)C_2H_4$—OH, $C_3H_6N(CH_3)_2$, most preferably $R_2$ and $R_3$ are hydrogen or one of $R_2$ and $R_3$ is $C_2H_4NH_2$, $C_2H_4N(H)C_2H_4$—OH or $C_3H_2N(CH_3)_2$.

High molecular weight succinimides are generally represented by the formula

[V]

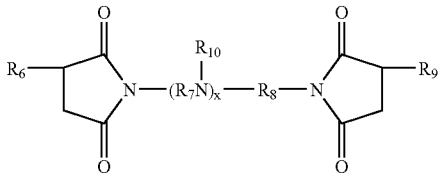

wherein $R_6$ and $R_9$ are the same or different high molecular weight hydrocarbyl group containing about 30 to 200 carbons and having a weight average molecular weight (Mw) of about 400 to 2800, preferably about 500 to about 2000, more preferably about 500 to 1500, still more preferably about 1000 to 1200, most preferably 1000-1200 Mw polyisobutylene, $R_7$ and $R_8$ are the same or different and are selected from $C_1$ to $C_{40}$ alkylene, preferably $C_1$-$C_4$ alkylene, more preferably $C_2$-$C_4$ alkylene and $R_{10}$ is hydrogen, $C_1$-$C_{10}$ alkyl, more preferably hydrogen.

Mannich bases are made from the reaction of alkylphenols, formaldehyde or alkylaldehydes and amines. See U.S. Pat. No. 4,767,551, which is incorporated herein by reference. Process aids and catalysts, such as oleic acid and sulfonic acids, can also be part of the reaction mixture. Molecular weights of the alkyl-phenols range from 800 to 2,500. Representative examples are shown in U.S. Pat. Nos. 3,697,574; 3,703,536; 3,704,308; 3,751,365; 3,756,953; 3,798,165; and 3,803,039, which are incorporated herein in their entirety by reference.

Typical Mannich base condensation products useful in this invention can be prepared from high molecular weight hydrocarbyl substituted hydroxy-aromatics, primary or secondary amines and formaldehyde, paraformaldehyde, or alkylaldehydes, or alkylaldehyde or formaldehyde precursors.

Examples of high molecular weight hydrocarbyl substituted hydroxy-aromatic compounds are polypropylphenol, polybutylphenol, and other poly-alkylphenols. These polyalkylphenols can be obtained by the alkylation, in the presence of an alkylating catalyst, such as $BF_3$, of phenol with high molecular weight polypropylene, polybutylene, polyisobutylene and other polyalkylene compounds to give alkyl substituents on the benzene ring of the phenol having a weight average molecular weight (Mw) of about 400 to 2800, preferably about 500 to about 2000, more preferably about 500 to 1500, still more preferably about 1000 to 1200, most preferably 1000-1200 Mw polyisobutylene or polypropylene.

Examples of reactants are alkylene polyamines, principally poly-ethylene polyamines, primary or secondary amine. Other representative organic compounds suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Amines having nitrogen contents corresponding to the alkylene polyamines in the formula $H_2N—(Z—NH—)_nH$, wherein Z is a divalent alkylene of $C_2$-$C_6$, and n is 1 to 10 are useful herein. Examples of alkylene polyamine reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines. Corresponding propylene polyamines such as propylene diamine and di-, tri-, tetra-, penta-propylene tri-, tetra-, penta- and hexaamines and mixtures thereof are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloro alkanes having 2 to 6 carbon atoms and the chlorines on different carbons are suitable alkylene polyamine reactants.

Aldehyde reactants useful in the preparation of the high molecular products useful in this invention include the aliphatic aldehydes such as formaldehyde (also as paraformaldehyde and formalin), acetaldehyde and aldol (β-hydroxybutyraldehyde). Formaldehyde or a formaldehyde-yielding reactant is preferred. Mannich bases can be represented by the following non-limiting formula:

[IX]

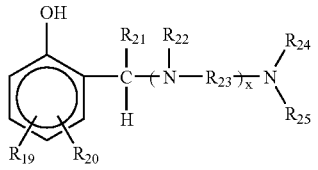

wherein $R_{19}$ is the same or different and each is selected from a high molecular weight hydrocarbyl group containing about 30 to 200 carbons and having a weight average molecular weigh (Mw) of about 400 to 2800, preferably about 500 to 2000, more preferably about 500 to 1500, still more preferably about 1000-1200, most preferably 1000-1200 Mw polyisobutylene or polypropylene;

$R_{20}$ is the same or different and selected from hydrogen or $C_1$-$C_{10}$ alkyl, preferably hydrogen or $C_1$-$C_4$ alkyl more preferably hydrogen or methyl;

$R_{21}$ is the same or different and selected from hydrogen or $C_1$-$C_4$ alkyl, preferably hydrogen or methyl, more preferably hydrogen;

$R_{22}$ is hydrogen or $C_1$-$C_4$ alkyl, preferably hydrogen or methyl, more preferably hydrogen;

$R_{23}$ is $C_1$-$C_{10}$ alkylene, $C_6$-$C_{10}$ arlylene, preferably $C_1$-$C_4$ alkylene, most preferably $C_2$-$C_3$ alkylene;

$R_{24}$ is hydrogen or $C_1$-$C_4$ alkyl, preferably hydrogen or methyl, more preferably hydrogen;

$R_{25}$ is hydrogen, $C_1$-$C_4$ alkyl, or

[X]

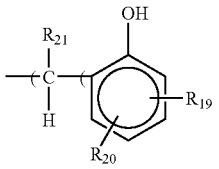

provided that both $R_{24}$ and $R_{25}$ are not hydrogen;

x is 1 to 10, preferably 1 to 4.

In addition to the detergents enumerated above, optionally carrier oils can also be present as such or as diluents for the detergents or as diluents, or reaction solvents used in the manufacture, of any other additive that may be added. Carrier oils include mineral oils, polyalkylenes, polyalphaolefins, polyalkylene oxides, polyethers, esters, and mixtures thereof, preferably 500-900 SUS mineral oils, 500-1000 Mw polyisobutylene, 500 to 1000 Mw poly-propylene, about 1000 Mw polypropylene oxide, about 1000 Mw polybutylene oxide, phthalates, trimellitate, adipates such as exemplified by the formula:

[VI]

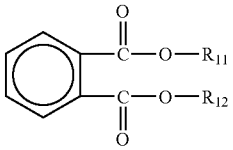

wherein $R_{11}$ and $R_{12}$ are the same or different and selected from $C_8$-$C_{15}$ alkyl, preferably $C_{10}$-$C_{13}$ alkyl,

[VII]

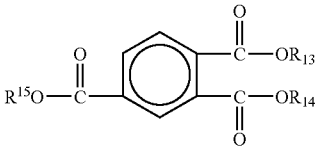

wherein $R_{13}$, $R_{14}$ and $R_{15}$ are the same or different and are selected from $C_6$-$C_{12}$ alkyl, preferably $C_8$-$C_{10}$ alkyl, and

[VIII]

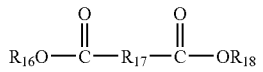

wherein $R_{16}$ and $R_{18}$ are the same or different and are selected from $C_6$-$C_{15}$ alkyl, preferably $C_6$ to $C_{10}$ alkyl and $R_{17}$ is a $C_1$-$C_{10}$ alkylene group.

It has been found that not all detergents heretofore known to control deposits in automobile engines caused by motor gasoline function to control deposits caused by aminated unleaded aviation gasoline.

A hydrocarbon fuel and a hydrocarbon fuel containing high levels (e.g., 1-20 wt %) of aromatic amines produce significantly different levels of gum and/or deposit due to the reactive nature of the amines. Specifically, the amine containing fuel will generate much more deposition, incorporate the amine molecule in the deposit, thereby producing a fundamentally different deposit than one generated from a hydrocarbon fuel which does not contain aromatic amines.

Because the deposits are fundamentally different, it would be unreasonable to expect all detergents that are effective on hydrocarbon derived deposits to be effective on an amine fuel derived deposits. The active mechanism that allows a detergent to work on a hydrocarbon fuel derived deposit would not be expected to be as effective or work at all on the fundamentally different deposit produced by hydrocarbon fuels containing aromatic amines.

Typical detergents such as polyether amines which are identified in the literature as effective detergents in automotive gasoline have been discovered to be unsatisfactory for controlling deposits caused by thermal deterioration of aminated unleaded aviation gasoline while quite unexpectedly materials selected from high molecular weight hydrocarbyl substituted amines, high molecular weight hydrocarbyl substituted succinimides, high molecular weight hydrocarbyl substituted Mannich bases and mixture thereof and optional carrier oil(s) have been found useful in controlling the toluene insoluble deposits formed by aminated aviation gasoline.

Further, even among those deposit control additives which have been found to control deposits derived from aminated fuels, it was expected that they would exhibit poor water separation properties. Unexpectedly it has been discovered that a number of the deposit control additives not only effectively control toluene insoluble deposits but also enable the fuels to exhibit satisfactory water separation properties. Aviation fuels operate in environment characterized by wide temperature swings. Fuels cooled from 75° F. down to 32° F. can throw off 12 ml of water per 100 gallons. Water in fuels at low temperature can freeze, forming ice crystals which plug fuel screens and filters. Enough water can result in ice plugs forming in fuel lines, carburetors or fuel injectors.

Fuels with poor water separation properties can solubilize more water and thus, at reduced temperature throw off even more ice.

Preferred deposit control additives have both the ability to control deposits and exhibit good water separation and are the high molecular weight hydrocarbyl amines, the high molecular weight hydrocarbyl substituted Mannich bases and mixtures thereof, and optional carrier oil(s).

Generally the aviation gasoline of the present invention contains anywhere from zero to up to about 25 wt % toluene, but preferably is of low toluene content, e.g., fuels containing zero to 6 wt % toluene, more preferably zero to 2 wt % toluene, most preferably zero to <1 wt % toluene.

Toluene is used as a solvent and when used in high volume helps to reduce fouling and deposit formation in conventional fuel but has only minimal impact on any toluene insoluble deposits which may be formed. When toluene is used or present in limited quantity when amines are used, fouling and formation of toluene insoluble deposits can still occur.

To control the toluene insoluble deposits it has been found necessary to utilize at least one of the deposit control additives described herein.

The aviation gasoline to which the deposit control additive is added may also contain other additives. Examples of such additional additives include TEL, antioxidants, toluene, metal deactivators and dyes. Co-solvents can also be present and they can include low molecular weight aromatics, alcohols, nitrates, esters, ethers, halogenated hydrocarbons and the like. With the phase out of TEL, other, different conventional octane boosters can be present, such as ethers, alcohols, and non-lead metals, including, e.g., ethyl tertiary butyl ether, methyl cyclopentadienyl manganese tricarbonyl, iron pentacarbonyl. Antioxidants such as 2-6 ditertbutyl hydroxy toluene (BHT) can be present in the fuel in an amount up to 200 mg/liter of fuel, preferably up to 100 mg/liter of fuel, more preferably up to 50 mg/liter of fuel, most preferably up to 24 mg/liter of fuel. Metal deactivators such as N,N-disalicylidene-1,2-propane diamine can be present in the fuel in an amount up to 50 ppm, preferably up to 25 wppm, most preferably up to about 10 wppm. Currently, approved additives for Avgas are listed in ASTM D-910.

The deposit control additive can be employed as a concentrate comprising the deposit control additive and at least one additional additive selected from antioxidant, toluene, metal deactivators or one or more aromatic amine(s) as taught in U.S. Pat. No. 5,470,358, the amount of any of those additional components in the additive concentrate being such that upon addition of the concentrate to the fuel in an amount sufficient to achieve a deposit control additive content in the fuel of up to about 1000 wppm active ingredient based on the total fuel, preferably 500 wppm active ingredient based on the total fuel, more preferably up to about 250 wppm active ingredient based on total fuel, most preferably up to about 100 wppm active ingredient based on total fuel, the amount of said additional additive(s) in the fuel is (are) within the ranges recited above for the particular additional additive(s). The concentrate can optionally contain carrier oil. The concentrate can also contain minor amounts of solvent which can be small volumes of the base gasoline itself or alkylate fractions.

Antioxidants and metal deactivators, such as BHT and N,N-disalicylidene1,2-propane diamine, may inhibit the reactions that cause deposit formation. The deposit control additives described in this invention do not necessarily inhibit the reactions which cause the initial deposit formation, but can be effective over a greater range of conditions, including temperature and concentration fluctuations and in addressing preexisting deposits.

EXAMPLES

Example 1

This example illustrates the toluene insoluble deposit formation of aviation alkylate fuels containing 4-isopropyl phenyl amine and the ability of different additives to control the toluene insoluble deposits. The fuel, unless otherwise indicated was alkylate containing 11 wt % 4-isopropyl phenyl amine.

The test was run in accordance with the procedure reported in U.S. Pat. No. 5,492,005. In the test n-heptane insolubles and toluene insolubles were measured and the fouling potential determined. In the test a metal nub is cycled between 150° C. and 300° C. in 9 minute cycles. About 40 ml of fuel is dripped on the nub in an air atmosphere. The nub is weighed before and after feed is dripped on it to five decimal places (0.00001 g). It is then washed with n-heptane and weighed and with toluene and weighed to determined the n-heptane and toluene insolubles. The results are presented in Table 1.

TABLE 1

| Sample | Base Fuel (Main Base is alkylate + 11 wt % IPPA unless otherwise indicated) | Additive | Additive Amount (1) | Active Additive (1) | Total Deposit (mg) | n-Heptane insoluble deposit (mg) | Toluene insoluble deposit (mg) | Improvement over Main Base (%) | Fouling Potential |
|---|---|---|---|---|---|---|---|---|---|
| 148-6 | Main Base | PIBSI 1000-1200 Mw hydrocarbyl groups | 200 | 100 | 0.21 | 0.11 | 0.08 | 43% | Mildly fouling |
| 148-7 | Main Base | Polyetheramine | 100 | 100 | 0.76 | 0.59 | 0.43 | −207% | Moderate fouling |
| 148-8 | Main Base | Mannich Base HITEC 6421 | 100 | 66 | 0.4 | 0.47 | 0.38 | −171% | Moderate fouling |
| 148-9 | Main Base | BHT + MDA | 250+4 | 25+4 | 0.92 | 0.24 | 0.08 | 43% | Mildly fouling |
| 148-10 | Main Base | none | 0 | 0 | 0.25 | 0.14 | 0.14 | 0% | Low-Moderate fouling |
| 148-11 | Main Base | PIBA 1000-1200 Mw hydrocarbyl groups | 185 | 100 | 0.54 | 0.38 | 0.06 | 57% | Mildly fouling |
| 157-11 | Main Base | none | 0 | 0 | 0.54 (0.50) | 0.53 (0.47) | 0.53 (0.40) | 28% delta | Moderate fouling (2 runs) |
| 157-13 | Main Base | PPO ~1000 Mw | 50 | 50 | 0.92 | 0.6 | 0.45 | 3%** | Moderate fouling |
| 157-14 | Main Base | PPO ~1000 Mw | 100 | 100 | 0.6 | 0.46 | 0.34 | 27%** | Moderate fouling |
| 157-15 | Main Base | BHT | 25 | 25 | 0.37 | 0.34 | 0.31 | 33%** | Moderate fouling |
| 157-16 | Main Base (wt) | MDA metal deactivator | 25 | 25 | 0.54 | 0.42 | 0.33 | 29%** | Moderate fouling |
| 157-22 | alkylate + 11 wt % old IPPA* | none | 0 | 0 | 0.35 | 0.3 | 0.2 | | Low-Moderate fouling |
| 157-23 | alkylate + 11 wt % new IPPA* | none | 0 | 0 | 0.29 | 0.23 | 0.22 | | Low-Moderate fouling |
| 163-2 | alkylate (wt) | none | 0 | 0 | 0 | 0 | 0 | | Non-fouling |
| 163-3 | Main Base | none | 0 | 0 | 0.15 | 0.15 | 0.11 | 0% | Low fouling |
| 163-4 | Main Base | Polyetheramine | 100 | 40 | 0.33 | 0.28 | 0.08 | 27% | Low fouling |
| 163-5 | Main Base | Polyetheramine | 300 | 120 | 0.59 | 0.29 | 0.13 | −18% | Low fouling |
| 163-6 | Main Base | Mannich Base HITEC 6421 | 100 | 66 | 0.05 | 0.05 | 0.06 | 45% | Non-Low fouling |
| 163-7 | Main Base | Mannich Base HITEC 6421 | 300 | 200 | 0.24 | 0.21 | 0.21 | −91% | Low-Moderate fouling |

*Samples 157-22 and 157-23 show that there is no deposit effect attributable to the age of the IPPA used.
IPPA-4-isopropylphenyl amine
BHT-2-6-ditertbutylhydroxy toluene
MDA-N,N-disalicylidene-1,2 propane diamine
**Percent calculated as improvement over average of the two main base runs $\left(\frac{0.53+0.40}{2} = 0.46 \text{ mg}\right)$
(1) For the samples in Series 148 and 163 amounts are in vppm.
For the samples in Series 157 amounts are in mg/liter.

Because of the nature of the test differences within 0.03 mg are considered to be within experimental error and not significant. For purposes of reliability only data from within the same sample group should be compared. Thus, the data within sample group 148 should be compared only against data from the same group and not against data/results from sample groups 157 or 163.

As can be seen from Table 1, polyether amine failed to function (Sample group 148) or functioned poorly (Sample Group 163) as a toluene insoluble deposit control additive.

Mannich bases gave mixed results, performing poorly in the tests of Sample group 148 but performing much better in the test of Sample group 163 giving especially acceptable performance in Test 163-6. The reasons for this difference in performance between samples is not understood but is not seen as disqualifying Mannich bases as useful deposit control additives.

Example 2

In this Example the various deposit control additives were evaluated for their effect on the water separation properties of animated aviation gasoline fuels. The base fuel was alkylate containing 11 wt % tert butyl phenyl amine and 11 wt % toluene. The water separation was determined using MSEP/water shedding test method ASTM D3948 Rev A setting B and using the yellow cell. This test was designed to rate the ability of aviation turbine fuels (JP-4 not gasoline) to release entrained or emulsified water when passed through fiberglass coalescing material. Although designed and intended for different fuels the test was modified herein in that it was applied to a gasoline and utilized as a convenient way to determine whether aviation gasoline fuels containing the recited additives could perform adequately in terms of water separation. In the test a fuel is mixed with water, passed through the coalescing cell then is placed in a turbidity meter. A more clear fuel will transmit more light indicating that water was shed/coalesced.

In Table 2 it is seen that aminated aviation gasoline containing poly-isobutyenyl succinimide exhibited very deleterious water separation properties in both of the test runs. Thus, although polyisobutenyl succinimide functions well as a toluene insoluble deposit control additive, its lack of adequate (or any) water separation activity would limit its utility as a deposit control additive.

| MSEP Test Using Setting B and the Yellow Cell | Set One | Set Two | Evaluation |
|---|---|---|---|
| Base fuel is 78 wt % alkylate + 11 wt % t-butylphenylamine + 11 wt % toluene | 63 | 95 | — |
| Base + 200 vppm PIBA 1000-1200 Mw hydrocarbyl | 70 | 85 | acceptable |
| Base + 200 vppm PIBSI 1000-1200 Mw hydrocarbyl | 0 | 1 | v. deleterious |
| Base + 200 vppm polyetheramine | 95 | 73 | acceptable |
| Base + 133 vppm Mannich Base HITEC 6421 | 58 | 78 | slightly negative/ acceptable |
| Base + 25 vppm BHT + 4 wppm MDA | 80 | 93 | acceptable |
| Base + 200 vppm Carrier Oil (polypropylene oxide)~1000 Mw | 90 | 84 | acceptable |
| Base + 25 vppm Carrier Oil polypropylene oxide~1000 Mw | x | 89 | acceptable |
| Base + 500 vppm Carrier Oil (polypropylene oxide)~1000 Mw | x | 94 | acceptable |
| Base + 100 vppm PIBA 1000-1200 Mw hydrocarbyl + 50 vppm Carrier Oil (polypropylene oxide)~1000 Mw | 85 | x | acceptable |
| Alkylate | 100 | x | — |
| Alkylate + 11 wt % toluene | x | 100 | — |
| Alkylate + 11 wt % t-butylphenylamine | x | 90 | — |
| Alkylate + 11 wt % t-butylphenylamine + 200 vppm carrier oil polypropylene oxide (~1000 Mw) | x | 89 | — |

Additives are listed on an active wppmv basis.

What is claimed is:

1. A method for reducing the level of toluene insolubles in aminated unleaded aviation gasoline while retaining good water shedding properties wherein such unleaded aminated aviation gasoline comprises (i) an unleaded aviation gasoline having a base MON of less than 98, and (ii) an amount of at least one aromatic amine effective to boost the motor octane number of the base fuel to at least 98, the aromatic amine having the formula

[I]

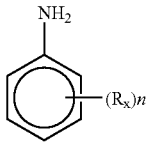

wherein $R_x$ is $C_1$-$C_{10}$ alkyl, a halogen or a mixture thereof, n is an integer from zero to 3 and wherein when n is 1 or 2 and $R_x$ is an alkyl group, the alkyl group occupies the meta and/or para position on the phenyl ring, by adding to such aminated unleaded aviation gasoline up to about 1000 wppm of a deposit control additive selected from the group consisting of high molecular weight hydrocarbyl amine, and mixtures of 2-6 ditertbutyl hydroxy toluene (BHT) and N,N disalicylidene-1,2 propane diamine (MDA) wherein the high molecular weight hydrocarbyl group has a weight average molecular weight of about 400-2800 Mw, and optional carrier oil(s), and wherein said unleaded animated aviation gasoline is characterized by toluene insoluble deposits of 0.8 mg or less measured by a test in which a metal nub is cycled between 150° C. and 300° C. in 9 minute cycles while about 40 ml of the aminated unleaded aviation gasoline is dripped on the nub in an air atmosphere, the nub weighed to five decimal places (0.00001 g) before and after the aminated unleaded gasoline aviation gasoline is dripped onto it, the nub then being washed with n-heptane and weighed and with toluene and weighed to determine the toluene insoluble deposits and water shedding properties as determined by MSEP/water shedding test method ASTM D3948 Rev. A setting B using the yellow cell of at least 70.

2. The method of claim 1 wherein the high molecular weight hydrocarbyl amine is of the formula:

[II]

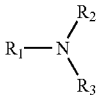

wherein $R_1$ is the high molecular weight hydrocarbyl group having a molecular weight (Mw) of about 400 to 2800, $R_2$ and $R_3$ are the same or different and are selected from hydrogen, $C_1$-$C_{10}$ alkyl,

[III]

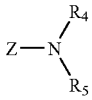

wherein Z is a $C_1$-$C_{10}$ alkylene, $R_4$ and $R_5$ are the same or different and are selected from hydrogen, $C_1$-$C_{10}$ alkyl, $C_1$-$C_{10}$—OH and optional carrier oil is selected from the group consisting of mineral oils, polyalkylenes, polyalkylene oxides, polyethers, esters, and mixtures thereof.

3. The method of claim 2 wherein $R_1$ is a high molecular weight hydrocarbyl group having a Mw of about 500 to 2000, $R_2$ and $R_3$ are the same or different and are selected from hydrogen, $C_2$-$C_4$ alkyl,

[IV]

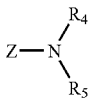

wherein Z is a $C_2$-$C_4$ alkylene, $R_4$ and $R_5$ are the same or different and a selected from hydrogen, $C_1$-$C_4$ alkyl, $C_1$-$C_4$—OH.

4. The method of claim 2 wherein the optional carrier oil is selected from one or more of 500-900 SUS mineral oil, 500-1000 molecular weight polyisobutylene, 500 to 1000 molecular weight polypropylene, about 1000 molecular weight polypropylene oxide, about 1000 molecular weight polybutylene oxide,

[VI]

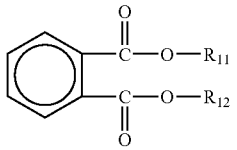

wherein $R_{11}$ and $R_{12}$ are the same or different and are selected from $C_8$-$C_{15}$, alkyl,

[VII]

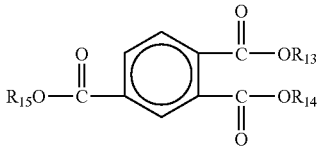

wherein $R_{13}$, $R_{14}$ and $R_{15}$ are the same or different and are selected from $C_6$-$C_{12}$ alkyl,

[VIII]

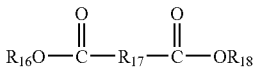

wherein $R_{16}$ and $R_{18}$ are the same or different and are selected from $C_6$-$C_{15}$ alkyl, and $R_{17}$ is a $C_1$-$C_{10}$ alkylene group.

5. The method of claim 3 wherein $R_1$ is 1000-1200 Mw polyisobutylene, $R_2$ and $R_3$ are the same or different and selected from hydrogen, $C_2H_4NH_2$, $C_2H_4N(H)C_2H_4$—OH, $C_3H_6N(CH_3)_2$.

6. The method of claim 5 wherein $R_1$ is 1000-1200 Mw polyisobutylene, $R_2$ and $R_3$ are hydrogen or one of $R_2$ and $R_3$ is $C_2H_4NH_2$, $C_2H_4N(H)C_2H_4$—OH or $C_3H_6N(CH_3)_2$.

7. The method of claim 4 wherein the optional carrier oil is selected from about 1000 molecular weight polypropylene oxide and about 1000 molecular weight polybutylene oxide.

8. The method of claim 1, 2, 3, 4, 5, or 6 wherein the deposit control additive is present in an amount up to about 500 wppm active ingredient.

9. The method of claim 8 wherein the deposit control additive is present in an amount up to about 250 wppm active ingredient.

10. The method of claim 8 wherein the deposit control additive is present in an amount up to about 100 wppm active ingredient.

11. An unleaded aminated high octane aviation gasoline having a MON of at least 98 comprising an unleaded aviation gasoline having a base MON of less than 98 and an effective amount of at least one aromatic amine effective to boost the MON of the base fuel to at least 98, the aromatic amine having the formula

[I]

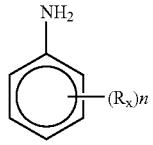

wherein $R_x$ is $C_1$-$C_{10}$ alkyl, halogen or a mixture thereof, n is an integer of from zero to 3 provided that when n is 1 or 2 and $R_x$ is alkyl it is in the meta and/or para position on the phenyl ring and up to about 1000 wppm active ingredient of an anti-deposit additive selected from the group consisting of high molecular weight hydrocarbyl amine and mixtures of 2-6 ditertbutyl hydroxy toluene (BHT) and N,N disalicylidene-1,2 propane diamine (MDA) wherein the high molecular weight hydrocarbyl group has a weight average molecular weight of about 400 to 2800 Mw, and optional carrier oil(s), and wherein said unleaded aminated high octane aviation gasoline is characterized by toluene insoluble deposits of no more than 0.06 mg measured by a test in which a metal nub is cycled between 150° C. and 300° C. in 9 minute cycles while about 40 ml of the aminated unleaded aviation gasoline is dripped on the nub in an air atmosphere, the nub weighed to five decimal places (0.00001 g) before and after the aminated unleaded aviation gasoline is dripped onto it, the nub then being washed with n-heptane and weighed and with toluene and weighed to determine the toluene insoluble deposits, and water separation property as determined by MSEP/water shedding test method ASTM D3948 Rev. A setting B using the yellow cell of at least 70.

12. The unleaded aminated high octane aviation gasoline of claim 11 wherein the deposit control additive is the high molecular weight hydrocarbyl amine which is of the formula

[II]

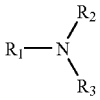

wherein $R_1$ is the high molecular weight hydrocarbyl group having a weight average molecular weight (Mw) of about 400 to 2800, $R_2$ and $R_3$ are the same or different and are selected from hydrogen, $C_1$-$C_{10}$ alkyl,

[III]

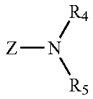

wherein Z is a $C_1$-$C_{10}$ alkylene, $R_4$ and $R_5$ are the same or different and are selected from hydrogen, $C_1$-$C_{10}$ alkyl, $C_1$-$C_{10}$—OH, and the optional carrier oil is selected from the group consisting of mineral oils, polyalkylenes, polyalkylene oxides, polyethers, esters and mixtures thereof.

13. The unleaded aminated high octane aviation gasoline of claim 12 wherein $R_1$ is a high molecular weight hydrocarbyl group having a weight average molecular weight of about 500 to 2000, $R_2$ and $R_3$ are the same or different and are selected from hydrogen, $C_2$-$C_4$ alkyl,

[IV]

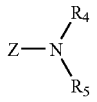

wherein Z is a $C_2$-$C_4$ alkylene, $R_(4$ and $R_5$ are the same or different and a selected from hydrogen, $C_1$-$C_4$ alkyl, $C_1$-$C_4$—OH.

14. The unleaded aminated high octane aviation gasoline of claim 11 wherein the optional carrier oil is selected from one or more of 500-900 SUS mineral oil, 500-1000 weight average molecular weight polyisobutylene, 500 to 1600 weight avenge molecular weight polypropylene, about 1000 weight average molecular weight polypropylene oxide, about 1000 weight average molecular weight polybutylene oxide,

[VI]

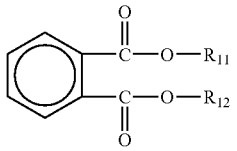

wherein $R_{11}$ and $R_{12}$ are the same or different and are selected from $C_8$-$C_{15}$ alkyl

[VII]

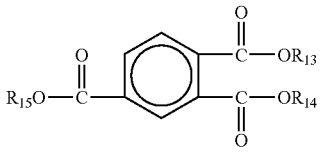

wherein $R_{13}$, $R_{14}$ and $R_{15}$ are the same or different and are selected from $C_6$-$C_{12}$ alkyl,

[VIII]

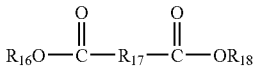

wherein $R_{16}$ and $R_{18}$ are the same or different and are selected from $C_6$-$C_{15}$ alkyl, and $R_{17}$ is a $C_1$-$C_{10}$ alkylene group.

15. The unleaded aminated high octane aviation gasoline of claim 12 wherein $R_1$ is 1000-1200 weight average molecular weight polyisobutylene, $R_2$ and $R_3$ are the same or different and selected from hydrogen, $C_2H_4NH_2$, $C_2H_4N(H)C_2H_4$—OH, $C_3H_6N(CH_3)_2$.

16. The unleaded aminated high octane aviation gasoline of claim 15 wherein $R_1$ is 1000-1200 weight average molecular weight polyisobutylene, $R_2$ and $R_3$ are hydrogen or one of $R_2$ and $R_3$ is $C_2H_4NH_2$, $C_2H_4N(H)C_2H_4$—OH or $C_3H_6N(CH_3)_2$.

17. The unleaded amninated high octane aviation gasoline of claim 14 wherein the optional carrier oil is selected from about 1000 weight average molecular weight polypropylene oxide and about 1000 weight average molecular weight polybutylene oxide.

18. The unleaded aminated high octane aviation gasoline of claim 11, 12, 13, 14, 15, 16 or 17 wherein the deposit control additive is present in an amount up to about 500 wppm active ingredient.

19. The unleaded aminated high octane aviation gasoline of claim 18 wherein the deposit control additive is present in an amount up to about 250 wppm active ingredient.

20. The unleaded aminated high octant aviation gasoline of claim 18 wherein the deposit control additive is present in an amount up to about 100 wppm active ingredient.

21. The unleaded aminated high octane aviation gasoline of claim 11 wherein the anti-deposit additive is a mixture of 2-6 ditertbutyl hydroxy toluene (BHT) and N,N disalicylidene-1,2 propane diamine (MDA).

22. An aviation gasoline fuel additive concentrate comprising a deposit control additive selected from the group consisting of high molecular weight hydrocarbyl amine and mixtures of 2-6 ditertbutyl hydroxy toluene (BHT) and N,N disalicylidene-1,2 propane diamine (MDA) and optional carrier oil(s) wherein the high molecular weight hydrocarbyl substituent has a weight average molecular weight of about 400 to 2800 Mw, and at least one additional compound selected from antioxidant, a metal deactivator, toluene, a solvent and one or more aromatic amines of the formula:

[I]

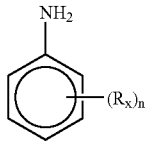

it is in the meta- and/or para-position on the phenyl ring wherein upon addition of the concentrate to aviation gasoline an additized aviation gasoline is produced characterized by toluene insoluble deposits of no more than 0.06 mg measured by a test in which a metal nub is cycled between 150° C. and 300° C. in 9 minute cycles while about 40 ml of the additized aviation gasoline is dripped on the nub in an air atmosphere, the nub weighed to five decimal places (0.0001 g) before and after the additized aviation gasoline is dripped onto it, the nub then being washed with n-heptane and weighed and with toluene and weighed to determine the toluene insoluble deposits, and water separation property as determined by MSEP/water shedding test method ASTM D3948 Rev. A setting B using the yellow cell of at least 70.

23. The aviation gasoline additive concentrate of claim 22 where the deposit control additive is a high molecular weight hydrocarbyl amine.

24. The aviation gasoline additive concentrate of claim 22 wherein the optional carrier oil is selected from one or more of 500-900 SUS mineral oil, 500-1000 weight average molecular weight polyisobutylene, 500 to 1600 weight average molecular weight polypropylene, about 1000 weight average molecular weight polypropylene oxide, about 1000 weight average molecular weight polybutylene oxide,

[VI]

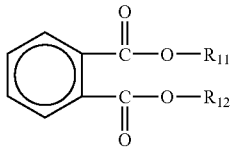

wherein $R_{11}$ and $R_{12}$ are the same or different and are selected from $C_8$-$C_{15}$ alkyl

[VII]

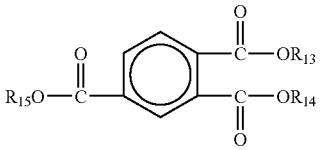

wherein $R_{13}$, $R_{14}$ and $R_{15}$ are the same or different and are selected from $C_6$-$C_{12}$ alkyl,

[VIII]

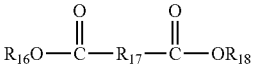

wherein $R_{16}$ and $R_{18}$ are the same or different and are selected from $C_6$-$C_{15}$ alkyl, and $R_{17}$ is a $C_1$-$C_{10}$ alkylene group.

25. The aviation gasoline fuel additive concentrate of claim 22, 23 or 24 comprising the deposit control additive and an antioxidant, the antioxidant being present in the concentrate in an amount sufficient such that upon addition of the concentrate to the aviation gasoline fuel to achieve a deposit control additive content in the fuel of up to about 1000 wppm as active ingredient based on the total fuel, the concentrate contributes an antioxidant content of up to 200 mg antioxidant/liter of fuel.

26. The aviation gasoline fuel additive concentrate of claim 22, 23 or 24 comprising the deposit control additive and toluene, the toluene being present in the concentrate in an amount sufficient such that upon addition of the concentrate to the aviation gasoline fuel to achieve a deposit control additive content in the fuel of up to about 1000 wppm active ingredient based on the total fuel, the concentrate contributes a toluene content of up to 25 wt % of the fuel.

27. The aviation gasoline fuel additive concentrate of claim 22, 23 or 24 comprising the deposit control formation additive and one or more aromatic amine the aromatic amines being present in the concentrate in a high enough concentration such that upon addition of the concentrate to the aviation gasoline fuel to achieve a deposit control additive content in the fuel of up to about 1000 wppm active ingredient based on the total fuel the concentrate contributes an aromatic amine content sufficient to boost the MON of the aviation gasoline to at least 98.

28. The aviation gasoline additive concentrate of claim 22, 23 or 24 comprising the deposit control additive and a metal deactivator in an amount sufficient such that upon addition of the concentrate to the fuel to achieve a deposit control additive content in the fuel of up to about 1000 wppm active ingredient based on the total fuel, the metal deactivator content of the fuel is up to about 50 wppm metal deactivator.

29. The aviation gasoline fuel additive concentrate of claim 27 additionally containing an antioxidant in an amount sufficient such that, upon addition of the concentrate to the fuel to achieve a deposit control additive content in the fuel of up to about 1000 wppm active ingredient based on the total fuel, the antioxidant content of the fuel is up to 200 mg antioxidant/liter of fuel.

30. The aviation gasoline fuel additive concentrate of claim 27 additionally containing toluene in an amount sufficient such that upon addition of the concentrate to the fuel to achieve a deposit control additive content in the fuel of up to about 1000 wppm active ingredient based on the total fuel the toluene content of the fuel is up to about 25 wt %.

31. The aviation gasoline fuel additive concentrate of claim 27 additionally containing an antioxidant and toluene, the antioxidant and the toluene being present in the concentrate in an amount sufficient such that upon addition of the concentrate to the fuel to achieve a deposit control additive content of up to about 1000 wppm active ingredient based on the total fuel the concentrate contributes an antioxidant content of up to 200 mg antioxidant/liter of fuel and a toluene content of up to 25 wt % of the fuel.

32. The aviation gasoline fuel additive concentrate of claim 25 additionally containing toluene in an amount sufficient such that upon addition of the concentrate to the fuel to achieve an anti-deposit additive content in the fuel to achieve an anti-deposit additive content in the fuel of up to about 1000 wppm active ingredient based on the total fuel, the toluene content of the fuel is up to about 25 wt %.

33. The aviation gasoline fuel additive concentrate of claim 28 additionally containing toluene in an amount sufficient such that upon addition of the concentrate to the fuel to achieve an anti-deposit additive content in the fuel to achieve an anti-deposit additive content in the fuel of up to about 1000 wppm active ingredient based on the total fuel, the toluene content of the fuel is up to about 25 wt %.

34. The aviation gasoline fuel additive concentrate of claim 22 wherein the deposit control additive is a mixture of 2-6 ditertbutyl hydroxy toluene (BHT) and N,N disalicylidene-1,2 propane diamine (MDA).

35. A method for providing an unleaded aminated aviation gasoline having a MON of at least 98 and low toluene insoluble deposit control which comprises providing for blending into an unleaded aviation gasoline comprising a base fuel having a MON of less than 98 and sufficient aromatic amine of the formula:

[I]

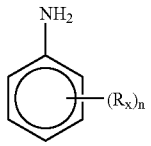

wherein $R_x$ is selected from the group consisting of $C_1$-$C_{10}$ alkyl, halogen or a mixture thereof, n is an integer of from zero to 3 provided that when n is 1 or 2 and $R_x$ is alkyl it is in the meta- and/or para position on the phenyl ring to boost the MON of the fuel to at least 98, an anti-deposit formation additive selected from the group consisting of high molecular weigh hydrocarbyl amine, and mixtures of 2-6 ditertbutyl hydroxy toluene (BHT) and N,N disalicylidene-1,2 propane diamine (MDA) and optional carrier oil(s) wherein the high molecular weight hydrocarbyl substituent has a weight average molecular weight of about 400 to 2800 Mw, wherein the unleaded aminated aviation gasoline is characterized by toluene insoluble deposits of no more than 0.06 mg measured by a test in which a metal nub is cycled between 150° C. and 300° C. in 9 minute cycles while about 40 ml of the unleaded aminated aviation gasoline is dripped on the nub in an air atmosphere, the nub weighed to five decimal points (0.0001 g) before and after the unleaded aminated aviation gasoline is dripped onto it, the nub then being washed with n-heptane and weighed and with toluene and weighed to determine toluene insoluble deposits, and water separation property as determined by MSEP/water shedding test method ASTM D3948 Rev. A setting B using the yellow cell of at least 70.

36. A method for providing an unleaded aviation gasoline having a MON of at least 98 which comprises providing for blending into an unleaded aviation gasoline having a MON of less than 98 which is intended for blending with an aromatic amine of the formula

[I]

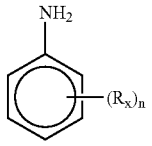

wherein $R_x$ is selected from the group consisting of $C_1$-$C_{10}$ alkyl, halogen or a mixture thereof, n is an integer of from zero to 3 provided that when n is 1 or 2 and $R_x$ is alkyl it is in the meta- and/or para position on the phenyl ring to boost the MON of the fuel to at least 98, a deposit control additive selected from the group consisting of high molecular weight hydrocarbyl amine and mixtures of 2-6 ditertbutyl hydroxy toluene (BHT) and N,N disalicylidene-1,2 propane diamine (MDA) and optional carrier oil(s) wherein the high molecular weight hydrocarbyl substituent has a weight average molecular weight of about 400 to 2800 Mw, wherein the unleaded aminated aviation gasoline is characterized by toluene insoluble deposits of no more than 0.06 mg measured by a test in which a metal nub is cycled between 150° C. and 300° C. in 9 minute cycles while about 40 ml of the unleaded aminated aviation gasoline is dripped on the nub in an air atmosphere, the nub weighed to five decimal points (0.0001 g) before and after the unleaded aminated aviation gasoline is dripped onto it, the nub then being washed with n-heptane and weighed and with toluene and weighed to determine toluene insoluble deposits, and water separation property as determined by MSEP/water shedding test method ASTM D3948 Rev. A setting B using the yellow cell of at least 70.

37. A method for providing an unleaded aviation gasoline having a MON of at least about 98 comprising providing for blending into an unleaded aviation gasoline having a MON of less than 98 a combination of an aromatic amine of the formula

[I]

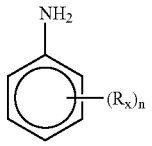

wherein $R_x$ is selected from the group consisting of $C_1$-$C_{10}$ alkyl, halogen or a mixture thereof, n is an integer of from zero to 3 provided that when n is 1 or 2 and $R_x$ is alkyl it is in the meta- and/or para position on the phenyl ring to boost the MON of the fuel to at least 98, a deposit control additive selected from the group consisting of high molecular weight hydrocarbyl amine, and mixtures of 2-6 ditertbutyl hydroxy toluene (BHT) and N,N disalicylidene-1,2 propane diamine (MDA) and optional carrier oil(s) wherein the high molecular weight hydrocarbyl substituent has a weight average molecular weight of about 400 to 2800 Mw, wherein the unleaded aminated aviation gasoline is characterized by toluene insoluble deposits of no more than 0.06 mg measured by a test in which a metal nub is cycled between 150° C. and 300° C. in 9 minute cycles while about 40 ml of the unleaded aminated aviation gasoline is dripped on the nub in an air atmosphere, the nub weighed to five decimal points (0.0001 g) before and after the unleaded aminated aviation gasoline is dripped onto it, the nub then being washed with n-heptane and weighed and with toluene and weighed to determine toluene insoluble deposits, and water separation property as determined by MSEP/water shedding test method ASTM D3948 Rev. A setting B using the yellow cell of at least 70.

38. The method of claim 35, 36 or 37 wherein the deposit control additive is the high molecular weight hydrocarbyl amine which is of the formula

[II]

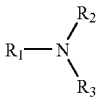

wherein $R_1$ is the high molecular weight hydrocarbyl group having a weight average molecular weight (Mw) of about 400 to 2800, $R_2$ and $R_3$ are the same or different and are selected from hydrogen, $C_1$-$C_{10}$ alkyl,

[III]

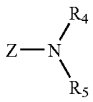

wherein Z is a $C_1$-$C_{10}$ alkylene, $R_4$ and $R_5$ are the same or different and are selected from hydrogen, $C_1$-$C_{10}$ alkyl, $C_1$-$C_{10}$—OH and the optional carrier oil is selected from the group consisting of mineral oils, polyalkylenes, polyalkylene oxides, polyethers, esters and mixtures thereof.

39. The method of claim 38 wherein $R_1$ is a high molecular weight hydrocarbyl group having a weight average molecular weight of about 500 to 2000, $R_2$ and $R_3$ are the same or different and are selected from hydrogen, $C_2$-$C_4$ alkyl, and

[IV]

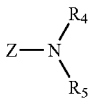

wherein Z is a $C_2$-$C_4$ alkylene, $R_4$ and $R_5$ are the same or different and a selected from hydrogen, $C_1$-$C_4$ alkyl, $C_1$-$C_4$—OH.

40. The method of claim 38 wherein the optional carrier oil is one or more of 500-900 SUS mineral oil, 500-1000 weight average molecular weight polyisobutylene, 500 to 1600 weight average molecular weight polypropylene, about 1000 weight average molecular weight polypropylene oxide, about 1000 weight average molecular weight polybutytene oxide,

[VI]

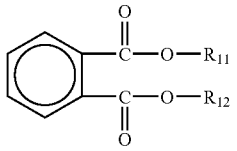

wherein $R_{11}$ and $R_{12}$ are the same or different and are selected from $C_8$-$C_{15}$ alkyl

[VII]

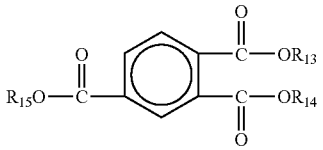

wherein $R_{13}$, $R_{14}$ and $R_{15}$ are the same or different and are selected from $C_6$-$C_{12}$ alkyl,

[VIII]

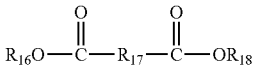

wherein $R_{16}$ and $R_{18}$ are the same or different and are selected from $C_6$-$C_{15}$ alkyl, and $R_{17}$ is a $C_1$-$C_{10}$ alkylene group.

41. The method of claim 1, 35, 36 or 37 wherein the deposit control additive is a mixture of 2-6 ditertbutyl hydroxy toluene (BHT) and N,N disalicylidene-1,2 propane diamine (MDA).

* * * * *